US009926726B1

(12) United States Patent
Santosa

(10) Patent No.: US 9,926,726 B1
(45) Date of Patent: Mar. 27, 2018

(54) TAMPER-PROOF PADLOCK BOX

(71) Applicant: Jatmiko Santosa, Salisbury, MD (US)

(72) Inventor: Jatmiko Santosa, Salisbury, MD (US)

( * ) Notice: Subject to any disclaimer, the term of this patent is extended or adjusted under 35 U.S.C. 154(b) by 0 days.

(21) Appl. No.: 15/703,847

(22) Filed: Sep. 13, 2017

Related U.S. Application Data

(60) Provisional application No. 62/393,828, filed on Sep. 13, 2016.

(51) Int. Cl.

| | |
|---|---|
| ***E05B 67/38*** | (2006.01) |
| ***E05B 67/04*** | (2006.01) |
| *E05B 41/00* | (2006.01) |
| *E05B 67/02* | (2006.01) |

(52) U.S. Cl.
CPC ..... *E05B 67/04* (2013.01); *E05B 67/38* (2013.01); *E05B 41/00* (2013.01); *E05B 67/02* (2013.01); *Y10T 70/498* (2015.04)

(58) Field of Classification Search
CPC ..... E05B 41/00; E05B 67/04; E05B 67/38; E05B 67/02; E05B 67/383; E05B 2067/386; Y10T 70/489; Y10T 70/493; Y10T 70/496; Y10T 70/498; Y10T 70/7921
USPC ..... 70/51, 52, 54–56, 417, 432, DIG. 43, 70/DIG. 56, DIG. 59; 292/148, 205, 292/DIG. 32
See application file for complete search history.

(56) References Cited

U.S. PATENT DOCUMENTS

| | | | | | |
|---|---|---|---|---|---|
| 2,766,605 | A * | 10/1956 | O'Brien | E05B 65/48 | 70/417 |
| 4,112,716 | A * | 9/1978 | Wippich | E05B 67/003 | 70/38 C |
| 4,686,840 | A * | 8/1987 | McCarroll | E05B 17/14 | 70/454 |
| 4,915,257 | A * | 4/1990 | Bailey | A47K 10/42 | 221/34 |
| 4,953,371 | A * | 9/1990 | Appelbaum | E05B 67/36 | 70/32 |
| 5,076,078 | A * | 12/1991 | Weger, Jr. | E05B 67/38 | 292/104 |
| 5,123,267 | A * | 6/1992 | Appelbaum | E05B 67/36 | 70/25 |
| 7,131,300 | B1 * | 11/2006 | Monasco | E05B 313/001 | 292/148 |
| 7,891,219 | B1 * | 2/2011 | Gogel | E05B 67/38 | 70/203 |
| 2005/0099018 | A1 * | 5/2005 | Witchey | E05B 67/38 | 292/218 |

(Continued)

*Primary Examiner* — Lloyd A Gall

(57) ABSTRACT

A tamper-proof padlock box which locks a door to a door frame that ensures that only users with a specialized key can access and open an internal lock. The tamper-proof padlock box includes a guard lock box, a padlock, and a key-receiving track mechanism. The padlock includes a U-shaped shank and a locking body. The guard lock box includes a tubular body, a bottom, a removable top, and a staple-receiving hole. The removable top is slidably mounted to the tubular body and supports the padlock. The U-shaped shank is rotatably mounted to the removable top about a leg of the U-shaped shank. The leg is oriented normal to the removable top. The staple-receiving hole allows a padlock staple access to the padlock and normally traverses through a rear sidewall. The key-receiving track mechanism is mechanically integrated into the bottom.

19 Claims, 7 Drawing Sheets

(56) References Cited

U.S. PATENT DOCUMENTS

| | | | | |
|---|---|---|---|---|
| 2008/0029529 | A1* | 2/2008 | Ruhl | B65D 90/008<br>220/890 |
| 2012/0125058 | A1* | 5/2012 | Papaiz | E05B 19/0082<br>70/31 |
| 2015/0191950 | A1* | 7/2015 | Bartley | E05B 67/38<br>70/2 |

* cited by examiner

TAMPER-PROOF PADLOCK BOX

The current application claims a priority to the U.S. Provisional Patent application Ser. No. 62/393,828 filed on Sep. 13, 2016.

FIELD OF THE INVENTION

The present invention relates generally to lock boxes which can secure a hinged door to a wall for secure closure. More specifically, the present invention uses a protected, key-operated lock to restrict door-operating access to users who have the appropriate key. The present invention utilizes a guard lock box to protect an internal padlock. This protects the locking mechanism of the present invention from tampering and exposure to the elements, and indicates its lock state to the user based on the position of its internal components.

BACKGROUND OF THE INVENTION

A variety of locking means are commonly utilized to secure areas away from undesirable or unintended users. Four-digit pad locks, combination locks, fingerprint sensors, and more are utilized to secure information and access across industries. These locks tend to be intricate, containing specialized technology and electronics to provide the desirable security. Due to low cost and simplicity of use, the key lock is among the most popular and longest-standing locking techniques for securing a physical space behind a closed door. The key lock utilizes a set of pins, which need to align precisely with a set of holes to allow the lock to turn and open. The key for a key lock is unique to each lock; when it is inserted into the correct lock, the pins arrange properly to allow the lock to open, thus allowing a user to access the previously protected area. This is still the preferred and most common method for protecting homes, rooms, safes, and more.

However, such common key locks have several disadvantages. The exposure of the lock to the elements can result in degradation of the lock, making the lock more vulnerable to vandalism. That exposure has further allowed a variety of picking and hacking methods that reduce the overall security of objects and spaces intended to be protected. What is needed is a key lock that protects the internal components from tampering by hostile parties, and from degradation due to long-term exposure to the elements. Such a key lock is more secure than standard locks because the main locking mechanism is not visible to the user.

The present invention addresses these concerns. The lock box utilizes a key lock that opens to separate locking components from securing components. The key is specific to each individual lock box, ensuring that only the holder of the correct key can unlock a door protected by a lock box. By mounting the main lock box apparatus on a door adjacent to a mounted plate on the wall, the user guarantees secure and simple closure of that door. An indicator system is used to inform the user as to the present status of the internal lock within the lock box.

DETAIL DESCRIPTIONS OF THE INVENTION

All illustrations of the drawings are for the purpose of describing selected versions of the present invention and are not intended to limit the scope of the present invention.

The present invention generally relates to locks and lock boxes. In particular, the present invention secures a door in the closed configuration and prevents unwanted entry or access to a space, room, or area behind the door. Additionally, the present invention protects an internal locking mechanism from external tampering and environmental factors. The present invention may be utilized with a variety of door designs.

Figure 1:
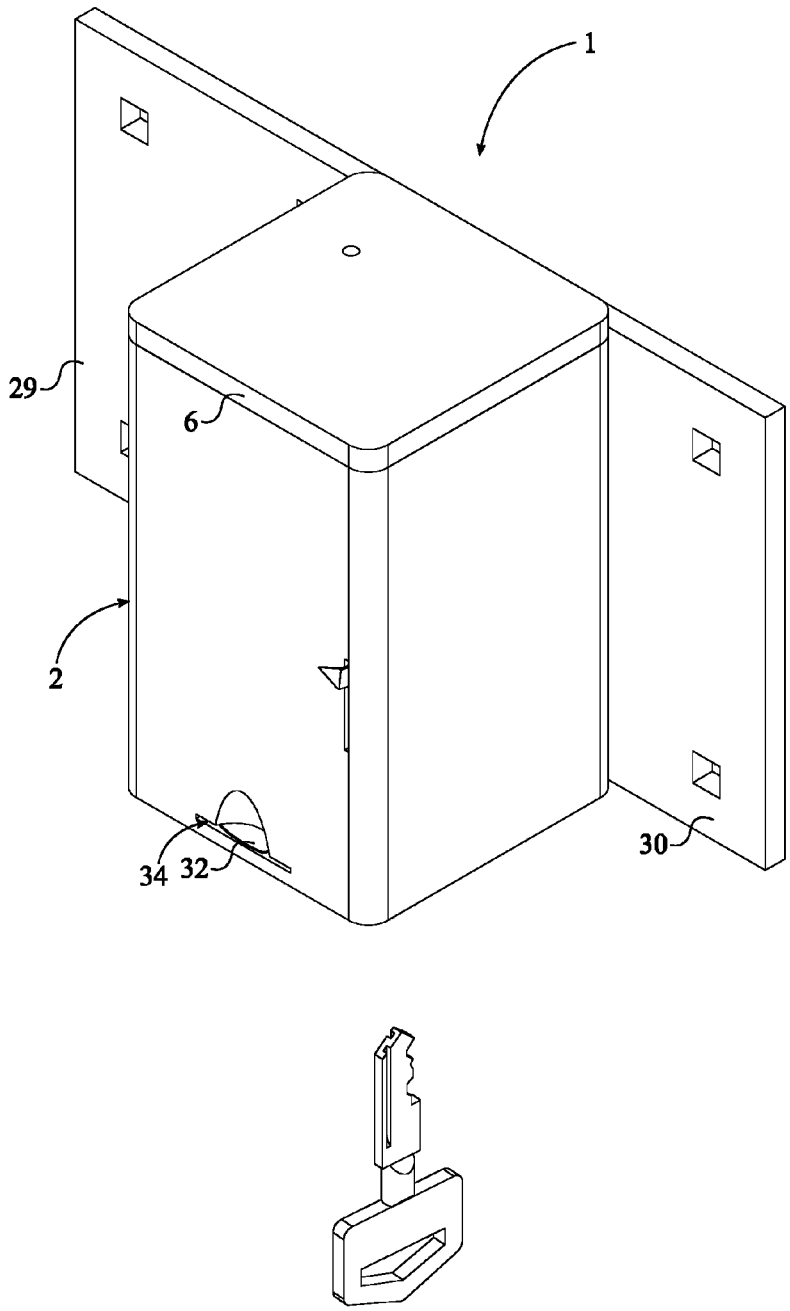
FIG. 1 is a perspective view of the present invention.
Figure 2:
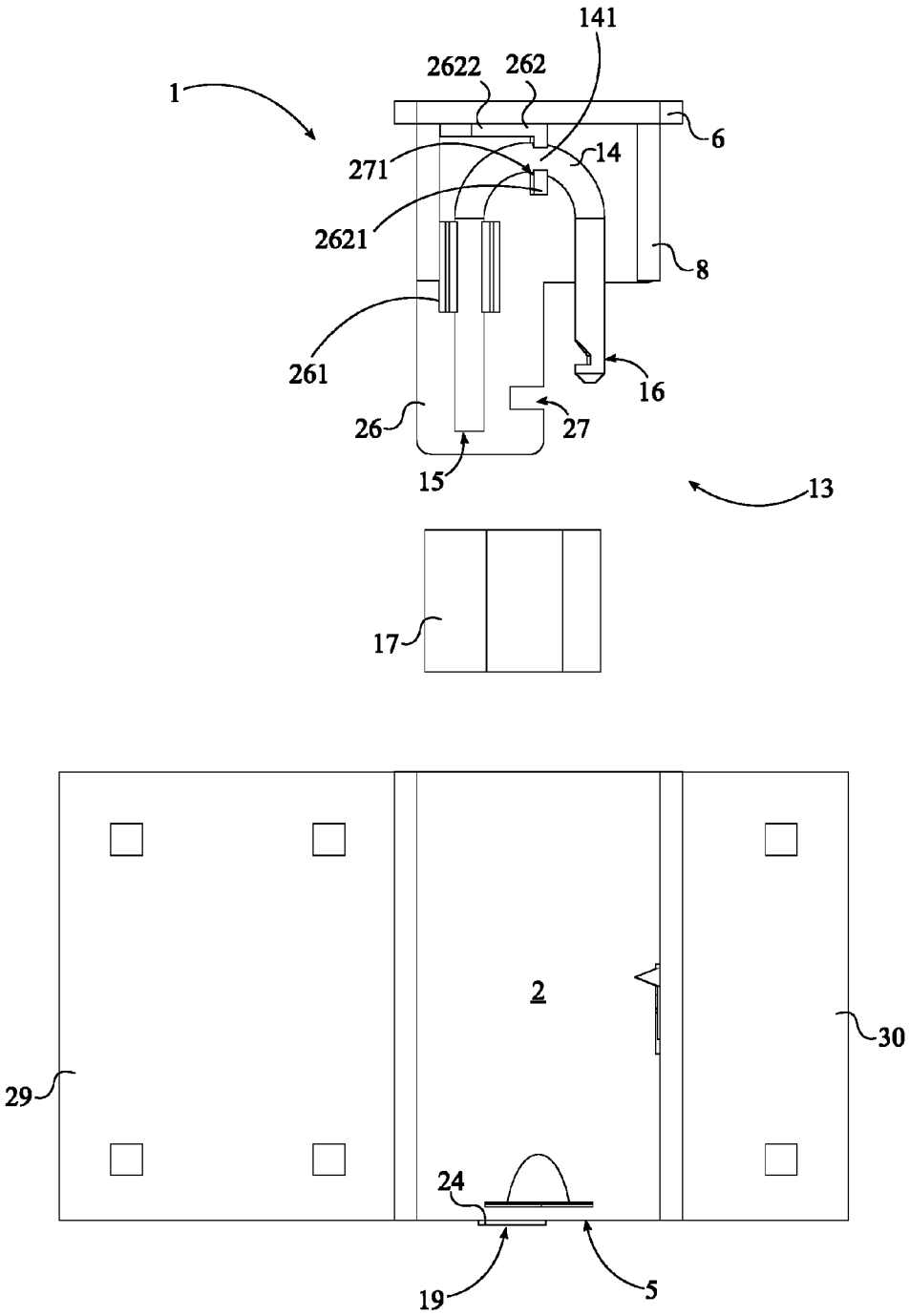
FIG. 2 is an exploded front view of the present invention.
Figure 3:
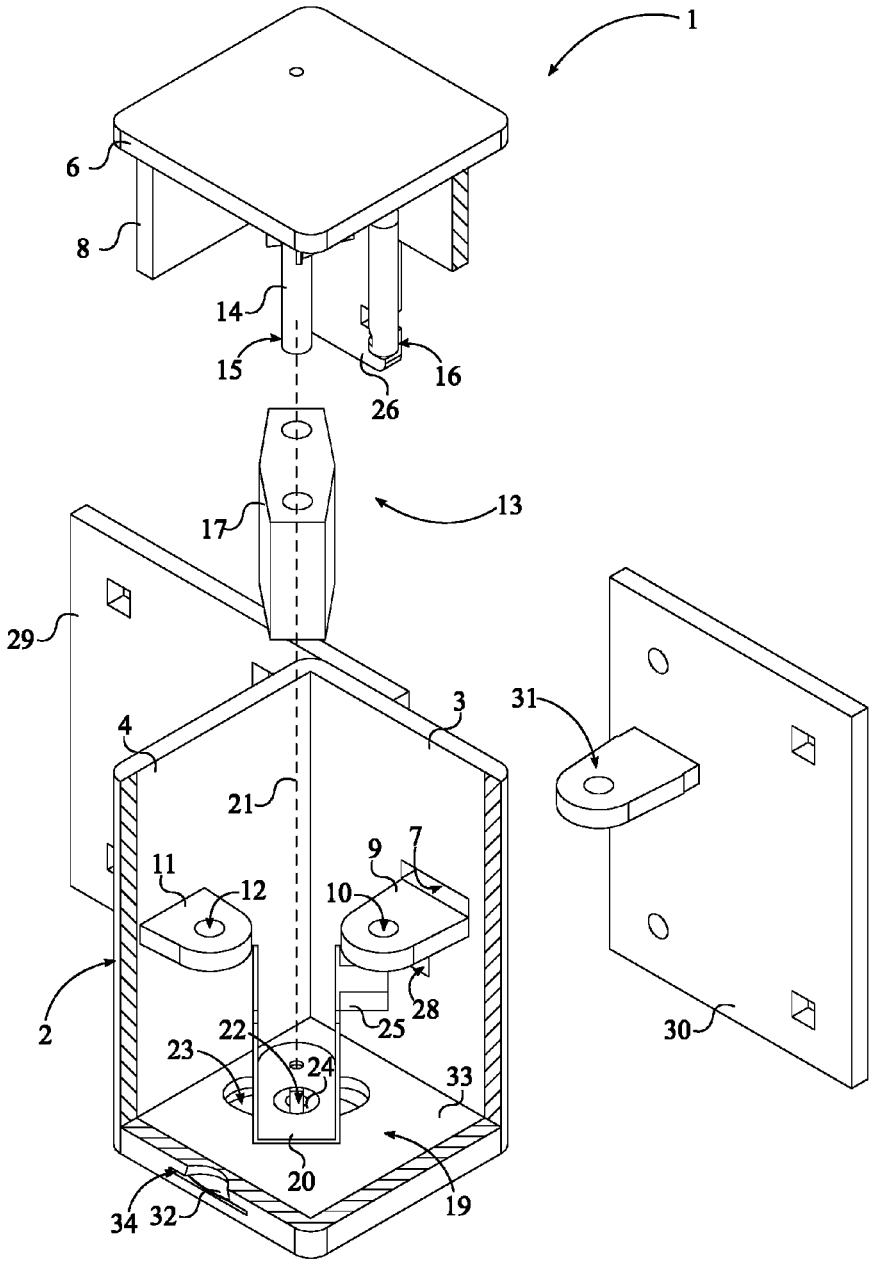
FIG. 3 is a cross-sectional and exploded perspective view of the present invention.

Referring to FIG. 1, FIG. 2, and FIG. 3 the present invention comprises a guard lock box 1, a padlock 13, a key-receiving track mechanism 19, a first mounting plate 29, a second mounting plate 30, and a padlock staple 31. The guard lock box 1 houses and protects the padlock 13 from tampering and environmental factors. The guard lock box 1 comprises a tubular body 2, a removable top 6, a staple-receiving hole 7, and a bottom 5. The tubular body 2 laterally encloses the padlock 13. The removable top 6 and the bottom 5 enclose and protect the upper and lower sections of the padlock 13. As such, the removable top 6 and the bottom 5 are positioned opposite to each other, across the tubular body 2. More specifically, the bottom 5 is a rectangular plate that is terminally and perpendicularly connected to the tubular body 2. The removable top 6 is a rectangular plate that is oriented perpendicular to the tubular body 2 and is slidably mounted to the tubular body 2. The sliding feature allows the user access to the internal space of the guard lock box 1 to remove, replace, and alter the configuration of the padlock 13 or other internal components of the present invention. More specifically, this allows the present invention to be configured into a locked configuration, a standby configuration, or a free configuration. It is preferred that the tubular body 2, the removable top 6, and the bottom 5 are all composed of a strong metal in order to secure the padlock 13 and other internal components of the present invention. The guard lock box 1 ensures that an intruder cannot simply cut through the padlock 13 in order to release the lock.

Figure 4:
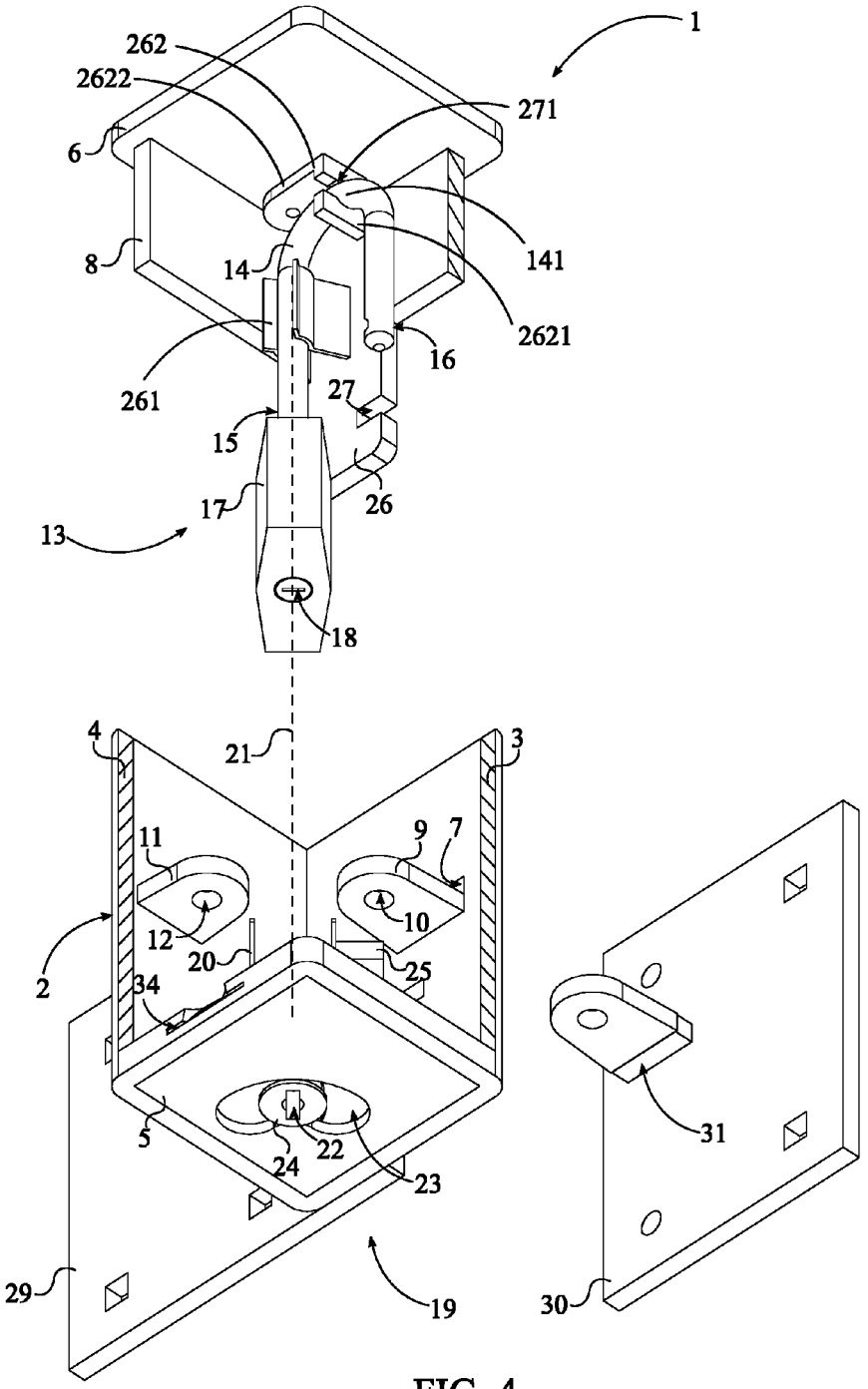
FIG. 4 is an alternative cross-sectional and exploded perspective view of the present invention.

The padlock 13 is a mechanical fastener designed to physically secure two or more structures together. Similar to traditional design, the padlock 13 comprises a U-shaped shank 14 and a locking body 17. The U-shaped shank 14 interlocks two structures to attach them to each other. The locking body 17 is mechanically attached to the U-shaped shank 14 and houses a pin tumbler lock in order to lock or release the U-shaped shank 14 to and from the locking body 17. Referring to FIG. 4, a leg 15 of the U-shaped shank 14 is oriented normal to the removable top 6, adjacent to the tubular body 2. Additionally, the U-shaped shank 14 is rotatably mounted to the removable top 6 about the leg 15. When the padlock 13 is positioned within the tubular body 2, the leg 15 is positioned adjacent to a rear sidewall 3 of the tubular body 2.

The present invention is designed to preferably be utilized for locking and unlocking a door to a corresponding door frame. Although, the present invention may be used for alternative structures and applications. In the preferred application, the first mounting plate 29 and the second mounting plate 30 are utilized to mount/attach the present invention to the door and the door frame. More specifically, the guard lock box 1 is mounted to the door by the first mounting plate 29. The first mounting plate 29 is a rectangular extrusion composed of a strong metal which attaches the guard lock box 1 to the door. The first mounting plate 29 is positioned adjacent and parallel to the rear sidewall 3 and is laterally connected to the tubular body 2. Complementary to the first mounting plate 29, the second mounting plate 30 is also a rectangular extrusion composed of a strong metal which attaches to the door frame. The second mounting plate 30, the padlock staple 31, and the staple-receiving hole 7 allow the guard lock box 1 to selectively attach to the door frame. The second mounting is connected normal to the padlock staple 31, similar to traditional locks. The staple-receiving hole 7 provides the padlock staple 31 access to the interior space of the guard lock box 1 and therefore the padlock 13. The staple-receiving hole 7 traverses normal through the rear sidewall 3 and is positioned laterally offset from the leg 15. When the door is closed flush with the door frame, the padlock staple 31 is positioned within the staple-receiving hole 7, thus allowing the padlock 13 to engaged and lock to the door frame through the padlock staple 31. In this position, the guard lock box 1, the padlock 13, the second mounting plate 30, the padlock staple 31 can be configured into the locked configuration. In the locked configuration, the padlock staple 31 is positioned within the staple-receiving hole 7 with the second mounting plate 30 being positioned parallel and adjacent to the rear sidewall 3. Within the guard lock box 1, the locking body 17 is positioned adjacent and parallel to the rear sidewall 3. This allows a free-end leg 16 of the U-shaped shank 14 to traverse through padlock staple 31 and terminally and mechanically engaged within the locking body 17. Resultantly, the guard lock box 1 and the padlock 13 are mechanically interlocked to the door frame through the padlock staple 31 and the second mounting plate 30. The first mounting plate 29 and the second mounting plate 30 may each be attached to the door and frame, respectively, through a variety of fastening mechanisms including, but not limited to, bolts, screws, and other similar mechanisms.

In order to lock and unlock the padlock 13 within the guard lock box 1, the key-receiving track mechanism 19 and a specialized key are utilized. The key-receiving track mechanism 19 is mechanically integrated into the bottom 5 and receives the specialized key for the padlock 13. Additionally, the key-receiving track mechanism 19 also allows the user to position the present invention into various configurations. More specifically, the key-receiving track mechanism 19 comprises a body-receiving bracket 20, a key hole 22, a semi-circular guide slot 23, and a slider knob 24. The body-receiving bracket 20 supports, tracks, and houses the locking body 17. Resultantly, the body-receiving bracket 20 is U-shaped and is sized to the outer dimensions of the locking body 17. The body-receiving bracket 20 is positioned within the tubular body 2, adjacent to the bottom 5. More specifically, the body-receiving bracket 20 is movable with respect to the bottom 5 and is rotatable about a bracket rotation axis 21, wherein the bracket rotation axis 21 is coincident with an extension line of the leg 15. This allows the body-receiving bracket 20 to rotate along the same path as the locking body 17, within the tubular body 2. When the padlock 13 is positioned within the tubular body 2, the locking body 17 is slidably engaged within the body-receiving bracket 20.

The semi-circular slot, the slider knob 24, and the key hole 22 receive the specialized key and ensure that, when inserted, the specialized key is aligned with a key slot 18 of the locking body 17; wherein the key slot 18 is centrally located on the locking body 17, opposite the U-shaped shank 14. The semi-circular guide slot 23 normally traverses through the bottom 5 and is coincident with the key slot 18. More specifically, the semi-circular guide slot 23 is coincident with the path the key slot 18 traces when the locking body 17 rotates about the leg 15. The slider knob 24 is a cylindrical body which acts as the interface component for the specialized key. The slider knob 24 is slidably engaged within and along the semi-circular guide slot 23. Additionally, the slider knob 24 is adjacently connected to the body-receiving bracket 20. The key hole 22 normally traverses through the slider knob 24 and the body-receiving bracket 20 in order to provide the specialized key access to the key slot 18 and therefore the pin tumbler lock within the locking body 17. Once inserted, translating the specialized key along the semi-circular guide slot 23 rotates the locking body 17 about the leg 15, thus changing the configuration of the present invention.

Figure 5:
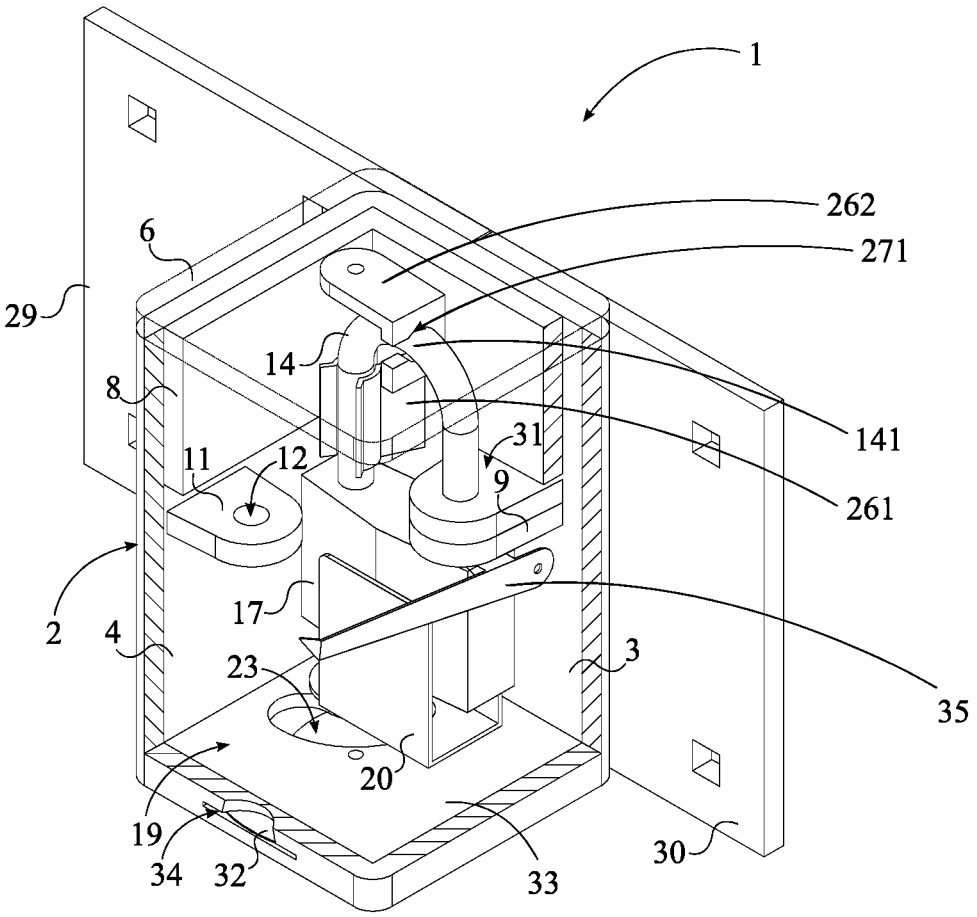
FIG. 5 is a cross-sectional perspective view of the present invention in a locked configuration.

In the preferred embodiment of the present invention, the key-receiving track mechanism 19 further comprises a tab 25, an arm plate 26, a notch 27, and a tab-receiving hole 28. The aforementioned components provide additional structural support when the present invention is configured into the locked configuration. In particular, the arm plate 26 is connected to the removable top 6 and interlocks with the body-receiving bracket 20 through the notch 27 and the tab 25. Referring to FIG. 4, the arm plate 26 is an elongated rectangular extrusion that is positioned parallel and adjacent to the rear sidewall 3. Additionally, the arm plate 26 is normally connected to the removable top 6. The tab 25 interlocks with the arm plate 26 and is laterally connected to the body-receiving bracket 20. The notch 27 laterally traverses through the arm plate 26, adjacent to the body-receiving bracket 20, and is sized complementary to the tab 25. When the present invention is configured into the locked configuration as seen in FIG. 5, the tab 25 is positioned within the notch 27, thus physically interlocking the body-receiving bracket 20 and the arm plate 26 together. The tab-receiving hole 28 further secures the tab 25 and arm plate 26 engagement. The tab-receiving hole 28 is positioned coplanar with the tab 25 and normally traverses through the rear sidewall 3. To further ensure that the arm plate 26 is securely held in place by the tab 25, the tab 25 is also positioned within the tab-receiving hole 28. This configuration anchors either end of the tab 25 to the guard lock box 1.

Referring to FIG. 3, the guard lock box 1 also comprises a first locking plate 9, a first shank-receiving hole 10, a second locking plate 11, and a second shank-receiving hole 12. The first locking plate 9 and the first shank-receiving hole 10 provide additional support for securing the padlock staple 31 to the guard lock box 1 through the padlock 13. The first locking plate 9 and the first shank-receiving hole 10 compliment the shape and size of the padlock staple 31. More specifically, the first locking plate 9 is positioned within the tubular body 2, in between the staple-receiving hole 7 and the bottom 5. Furthermore, the first locking plate 9 is connected perpendicular to the rear sidewall 3, adjacent to the staple-receiving hole 7. The first shank-receiving hole 10 is sized complementary to the U-shaped shank 14 and normally traverses through the first locking plate 9. When the present invention is positioned into the locking configuration, the padlock staple 31 and the first shank-receiving hole 10 are positioned concentric with each other. Additionally, the free-end leg 16 traverses through both the padlock staple 31 and the first shank-receiving hole 10.

Figure 6:
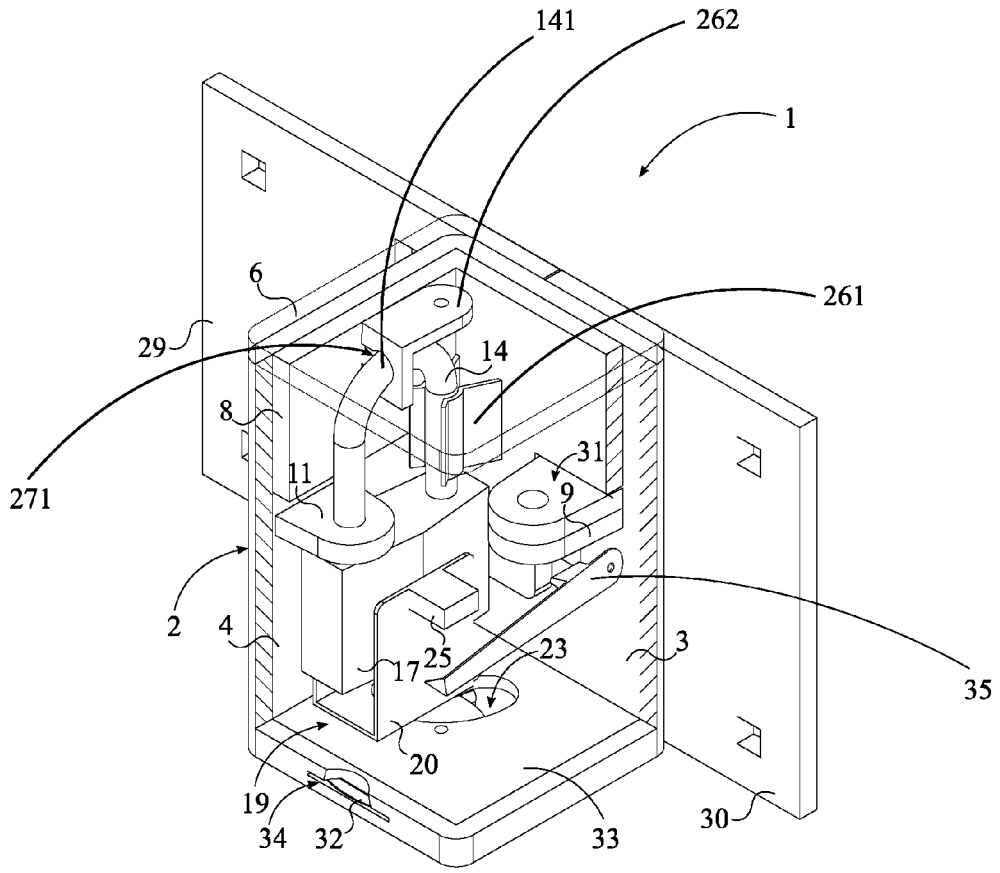
FIG. 6 is a cross-sectional perspective view of the present invention in a standby configuration.

The second locking plate 11 and the second shank-receiving hole 12 allow for the present invention to be positioned into the standby configuration as seen in FIG. 6. The standby configuration allows the padlock staple 31 to freely translate in and out of the guard lock box 1, i.e. the door is free to open and close relative to the door frame. The second locking plate 11 is positioned in between the bottom 5 and the staple-receiving hole 7. Additionally, the second locking plate 11 is connected perpendicular to a left sidewall 4 of the tubular body 2. The second shank-receiving hole 12 is sized complementary to the U-shaped shank 14 and normally traverses through the second locking plate 11. In the standby configuration, the locking body 17 is positioned adjacent to the left sidewall 4 and the free-end leg 16 traverses through the second shank-receiving hole 12. This secures the padlock 13 to the left sidewall 4. The padlock 13 is further secured in this configuration with the free-end leg 16 being mechanically engaged within the locking body 17. In other words, the standby configuration locks the padlock 13 away from the rear sidewall 3 when the present invention is not used to lock the door to the door frame. Any position of the padlock 13 in between the locked configuration and the standby configuration is the free configuration.

Referring to FIG. 2, to provide additional layer of protection to the padlock 13, the guard lock box 1 further comprises a sliding enclosure 8. The sliding enclosure 8 is a plate bent at two spots to yield a U-shape to enclose the padlock 13 from multitude sides. Additionally, the removable top 6 is slidably mounted to the tubular body 2 by the sliding enclosure 8. More specifically, the sliding enclosure 8 is positioned about the padlock 13 and is perpendicularly connected to the removable top 6. The width of the sliding enclosure 8 is complementary to the inner width of the tubular body 2 such that the sliding enclosure 8 fits within the tubular body 2. As a result, the sliding enclosure 8 is slidably engaged within the tubular body 2.

Referring to FIG. 4, in the preferred embodiment, the padlock 13 is mounted to the removable top 6 and the arm plate 26 through a lock holster 261 and a mounting arm 262. The lock holster 261 is a tubular extrusion with a slot running along the length of the lock holster 261. The lock holster 261 is positioned along the arm plate 26 and is adjacently connected to the arm plate 26. The mounting arm 262 is an L-shaped extrusion with a semi-circular notch 271 cut into a first leg 2621 of the mounting arm 262. A second leg 2622 of the mounting arm 262 is rotatably attached to the removable top 6, wherein the rotation axis of the second leg 2622 coincides with the central axis of the lock holster 261. The lock holster 261 receives the leg 15 while the mounting arm 262 receives a curved portion 141 of the U-shaped shank 14. In this embodiment, the curved portion 141 has a circular cross-section in order to complementary fit within the semi-circular notch 271. This configuration allows the user to replace the padlock 13 if need be, while simultaneously allowing the padlock 13 to rotate about the leg 15. Additionally, it is preferred that the locking body 17 is biased towards a specific orientation relevant to the U-shaped shank 14. More specifically, the padlock 13 is biased to a state wherein the locking body 17 is at a 45-degree angle with the free-end leg 16. This allows the user to more easily insert and install the padlock 13 into the guard lock box 1.

In the preferred use of the present invention, the user mounts the first mounting plate 29 to the door and mounts the second mounting plate 30 to the door frame through a plurality of screws, wherein the first mounting plate 29 and the second mounting plate 30 are vertically aligned. In order to install the padlock 13 and set the present invention to a specific configuration, the user initially orients the leg 15 and the free-end leg 16 of the U-shaped shank 14 parallel to the removable top 6 and slides the curved portion 141 into the semi-circular notch 271. Next, the user rotations the U-shaped shank 14 until the leg 15 is parallel with the arm plate 26 and is pushed within the lock holster 261. Reversing the process will remove the padlock 13. In alternative embodiments of the present invention, alternative methods and devices may be used to mount the padlock 13 to the removable top 6. To complete the install the padlock 13 within the guard lock box 1, the user then positions the body-receiving bracket 20 at a 45 degrees angle relative to the rear sidewall 3 and lowers the locking body 17 into the body-receiving bracket 20. Simultaneously, the user has the option at positioning the free-end leg 16 through the first shank-receiving hole 10 and the padlock staple 31 or through the second shank-receiving hole 12. Positioning the free-end leg 16 through the first shank-receiving hole 10 and the padlock staple 31 will configure the present invention into the locked configuration. Positioning the free-end leg 16 through the second shank-receiving hole 12 will configure the present invention into the standby configuration. Once a configuration is selected, the user then inserts the specialized key into the key slot 18 through the key hole 22 and translates the slider knob 24 towards either the rear sidewall 3 or the left sidewall 4, corresponding to the desired configuration. To lock the selected configuration, the user pushes the specialized key towards the bottom 5, thus causing the free-end leg 16 to engage within the locking body 17 and overall locking the padlock 13. To release either the locked configuration or the standby configuration, the user simply inserts and turns the specialized key into the key slot 18 through the key hole 22, thus unlocking the padlock 13.

Figure 7:
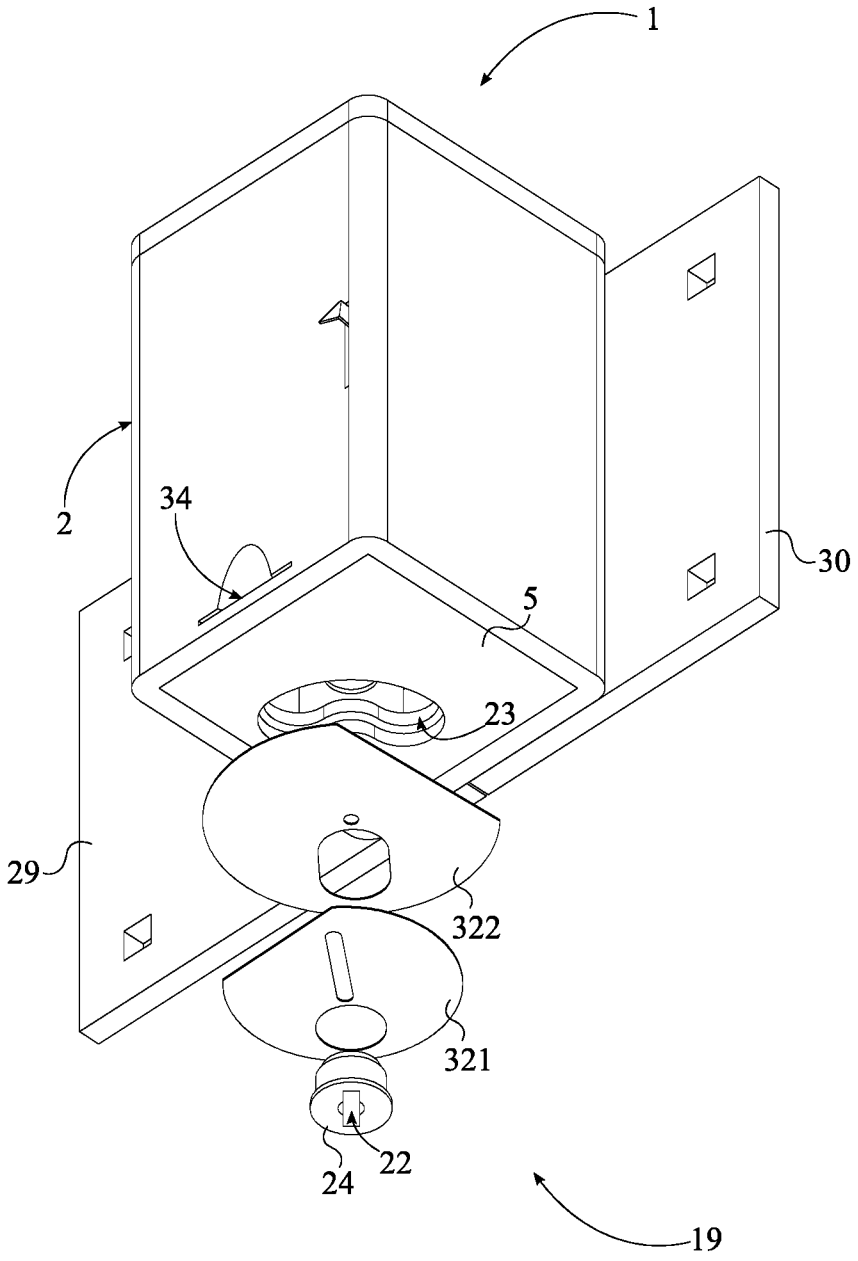
FIG. 7 is a bottom perspective and partially exploded view depicting a key-receiving track mechanism.

Referring to FIG. 7, the present invention also provides the user with a means of conveying the current position and status of the present invention. More specifically, the present invention further comprises an indication disk 32, a housing plate 33, a viewing slot 34, and an indication arm 35. The indication disk 32 and the viewing slot 34 convey to the user the location of the body-receiving bracket 20 and therefore the locking body 17 within the tubular body 2. The indication disk 32 comprises a first indication disk 321 and a second indication disk 322. The housing plate 33 is positioned parallel and offset from the bottom 5 in order to create space for the first indication disk 321 and the second indication disk 322. Additionally, the housing plate 33 is perimetrically connected within the tubular body 2. In the preferred embodiment, the body-receiving bracket 20 is movable with respect to the housing plate 33. In order to connect the slider knob 24 to the body-receiving bracket 20, the semi-circular guide slot 23 traverses through the housing plate 33. The viewing slot 34 laterally traverses into the tubular body 2, in between the bottom 5 and the housing plate 33 in order to expose the internal components, i.e. the indication disk 32 comprises the first indication disk 321 and the second indication disk 322. The indication disk 32 is positioned in between the bottom 5 and the housing plate 33.

The indication disk 32 is eccentrically engaged with the slider knob 24 such that when the slider knob 24 slides along the semi-circular guide slot 23, the indication disk 32 rotates accordingly. Additionally, the indication disk 32 is sized such that a portion of the indication disk 32 is exposed through the viewing slot 34. This conveys to the user the specific configuration of the present invention. An outer portion of the indication disk 32 is marked, cut off, or contains another means of identification. Different marked portion of the indication disk 32 show a different configuration of the present invention.

The indication arm 35 conveys the vertical location of the locking body 17. More specifically, the indication arm 35 is rotatably connected to a right sidewall of the tubular body 2 and is mechanically coupled to the locking body 17. A free end of the indication arm 35 traverses through the tubular body 2 in order to signal the user of the vertical location of the locking body 17.

Although the invention has been explained in relation to its preferred embodiment, it is to be understood that many other possible modifications and variations can be made without departing from the spirit and scope of the invention as hereinafter claimed.

What is claimed is:

1. A tamper-proof padlock box comprising:
- a guard lock box;
- a padlock;
- a key-receiving track mechanism;
- the padlock comprising a U-shaped shank and a locking body;
- the guard lock box comprising a tubular body, a bottom, a removable top, and a staple-receiving hole;
- the removable top and the fixed bottom being positioned opposite to each other, across the tubular body;
- the removable top being slidably mounted to the tubular body;
- a leg of the U-shaped shank being oriented normal to the removable top, adjacent to the tubular body;
- the U-shaped shank being rotatably mounted to the removable top about the leg;
- the leg being positioned adjacent to a rear sidewall of the tubular body;
- the staple-receiving hole being laterally offset from the leg;
- the staple-receiving hole traversing normal through the rear sidewall; and
- the key-receiving track mechanism being mechanically integrated into the bottom.

2. The tamper-proof padlock box as claimed in claim 1 comprising:
- a first mounting plate;
- the first mounting plate being positioned adjacent and parallel to the rear sidewall; and
- the first mounting plate being laterally connected to the tubular body.

3. The tamper-proof padlock box as claimed in claim 1 comprising:
- the key-receiving track mechanism comprising a body-receiving bracket, a key hole, a semi-circular guide slot, and a slider knob;
- the semi-circular guide slot normally traversing through the bottom;
- the semi-circular guide slot being coincident with a key slot of the locking body;
- the body-receiving bracket being positioned within the tubular body, adjacent to the bottom;
- the body-receiving bracket being movable with respect to the bottom;
- the body-receiving bracket being rotatable about a bracket rotation axis;
- the bracket rotation axis being positioned coincident with an extension line of the leg;
- the slider knob being slidably engaged within and along the semi-circular guide slot;
- the slider knob being adjacently connected to the body-receiving bracket;
- the key hole normally traversing through the slider knob and the body-receiving bracket; and
- the locking body being slidably engaged within the body-receiving bracket.

4. The tamper-proof padlock box as claimed in claim 1 comprising:
- a second mounting plate;
- a padlock staple;
- wherein the guard lock box, the padlock, the second mounting plate, and the padlock staple are configured into a locked configuration;
- the padlock staple being positioned within the staple-receiving hole;
- the second mounting plate being positioned parallel and adjacent to the rear sidewall;
- the second mounting plate being connected normal to the padlock staple;
- the locking body being positioned adjacent and parallel to the rear sidewall;
- a free-end leg of the U-shaped shank traversing through the padlock staple; and
- the free-end leg of the U-shaped shank being terminally and mechanically engaged within the locking body.

5. The tamper-proof padlock box as claimed in claim 3 comprising:
- wherein the guard lock box, the padlock, a second mounting plate, a padlock staple, and the key-receiving track mechanism are configured into a locked configuration;
- the key-receiving track mechanism further comprising a tab, an arm plate and a notch;
- the arm plate being positioned parallel and adjacent to the rear sidewall;
- the arm plate being normally connected to the removable top;
- the notch laterally traversing through the arm plate, adjacent to a body-receiving bracket from the key-receiving track mechanism;
- the tab being laterally connected to the body-receiving bracket; and
- the tab being positioned within the notch.

6. The tamper-proof padlock box as claimed in claim 3 comprising:
- the key-receiving track mechanism further comprising a tab-receiving hole;
- the tab-receiving hole being positioned coplanar with a tab;
- the tab-receiving hole normally traversing through the rear sidewall; and
- the tab being positioned within a notch and the tab-receiving hole.

7. The tamper-proof padlock box as claimed in claim 3 comprising:
- the guard lock box further comprising a first locking plate and a first shank-receiving hole;
- the first locking plate being positioned within the tubular body;

the first locking plate being positioned in between the staple-receiving hole and the bottom;

the first locking plate being connected perpendicular to the rear sidewall, adjacent to the staple-receiving hole;

the first shank-receiving hole normally traversing through the first locking plate; and a free-end leg of the U-shaped shank traversing through a padlock staple and the first shank-receiving hole.

8. The tamper-proof padlock box as claimed in claim 1 comprising:

the guard lock box further comprising a sliding enclosure;

the sliding enclosure being positioned about the padlock;

the sliding enclosure being connected perpendicular to the removable top; and the sliding enclosure being slidably engaged within the tubular body.

9. The tamper-proof padlock box as claimed in claim 1 comprising:

wherein the guard lock box and the padlock are configured into a standby configuration;

the guard lock box further comprising a second locking plate and a second shank-receiving hole;

the second locking plate being positioned in between the bottom and the staple-receiving hole;

the second locking plate being connected perpendicular to a left sidewall of the tubular body;

the second shank-receiving hole normally traversing through the second locking plate;

the locking body being positioned adjacent and parallel to the left sidewall;

a free-end leg of the U-shaped shank traversing through the second shank-receiving hole; and the free-end leg of the U-shaped shank being mechanically engaged within the locking body.

10. The tamper-proof padlock box as claimed in claim 3 comprising:

at least one indication disk;

a housing plate;

a viewing slot;

the housing plate being positioned parallel and offset from the bottom;

the housing plate being perimetrically connected within the tubular body;

the body-receiving bracket being movable with respect to the housing plate;

the semi-circular guide slot traversing through the housing plate;

the at least one indication disk being positioned in between the bottom and the housing plate;

the at least one indication disk being rotatably mounted within the tubular body;

the at least one indication disk being eccentrically engaged with the slider knob; and the viewing slot laterally traversing into the tubular body, in between the bottom and the housing plate.

11. A tamper-proof padlock box comprising:

a guard lock box;

a padlock;

a key-receiving track mechanism;

the padlock comprising a U-shaped shank and a locking body;

the guard lock box comprising a tubular body, a bottom, a removable top, and a staple-receiving hole;

the key-receiving track mechanism comprising a body-receiving bracket, a key hole, a semi-circular guide slot, and a slider knob;

the removable top and the bottom being positioned opposite to each other, across the tubular body;

the removable top being slidably mounted to the tubular body;

a leg of the U-shaped shank being oriented normal to the removable top, adjacent to the tubular body;

the U-shaped shank being rotatably mounted to the removable top about the leg;

the leg being positioned adjacent to a rear sidewall of the tubular body;

the staple-receiving hole being laterally offset from the leg;

the staple-receiving hole traversing normal through the rear sidewall;

the key-receiving track mechanism being mechanically integrated into the bottom;

the semi-circular guide slot normally traversing through the bottom;

the semi-circular guide slot being coincident with a key slot of the locking body;

the body-receiving bracket being positioned within the tubular body, adjacent to the bottom;

the body-receiving bracket being movable with respect to the bottom;

the body-receiving bracket being rotatable about a bracket rotation axis;

the bracket rotation axis being positioned coincident with an extension line of the leg;

the slider knob being slidably engaged within and along the semi-circular guide slot;

the slider knob being adjacently connected to the body-receiving bracket;

the key hole normally traversing through the slider knob and the body-receiving bracket; and the locking body being slidably engaged within the body-receiving bracket.

12. The tamper-proof padlock box as claimed in claim 11 comprising:

a first mounting plate;

the first mounting plate being positioned adjacent and parallel to the rear sidewall; and the first mounting plate being laterally connected to the tubular body.

13. The tamper-proof padlock box as claimed in claim 11 comprising:

a second mounting plate;

a padlock staple;

wherein the guard lock box, the padlock, the second mounting plate, and the padlock staple are configured into a locked configuration;

the padlock staple being positioned within the staple-receiving hole;

the second mounting plate being positioned parallel and adjacent to the rear sidewall;

the second mounting plate being connected normal to the padlock staple;

the locking body being positioned adjacent and parallel to the rear sidewall;

a free-end leg of the U-shaped shank traversing through the padlock staple; and the free-end leg of the U-shaped shank being terminally and mechanically engaged within the locking body.

14. The tamper-proof padlock box as claimed in claim 13 comprising:

wherein the guard lock box, the padlock, the second mounting plate, the padlock staple, and the key-receiving track mechanism are configured into a locked configuration;

the key-receiving track mechanism further comprising a tab, an arm plate and a notch;

the arm plate being positioned parallel and adjacent to the rear sidewall;

the arm plate being normally connected to the removable top;

the notch laterally traversing through the arm plate, adjacent to the body-receiving bracket from the key-receiving track mechanism;

the tab being laterally connected to the body-receiving bracket; and the tab being positioned within the notch.

15. The tamper-proof padlock box as claimed in claim 13 comprising:

the key-receiving track mechanism further comprising a tab-receiving hole;

the tab-receiving hole being positioned coplanar with a tab;

the tab-receiving hole normally traversing through the rear sidewall; and the tab being positioned within a notch and the tab-receiving hole.

16. The tamper-proof padlock box as claimed in claim 13 comprising:

the guard lock box further comprising a first locking plate and a first shank-receiving hole;

the first locking plate being positioned within the tubular body;

the first locking plate being positioned in between the staple-receiving hole and the bottom;

the first locking plate being connected perpendicular to the rear sidewall, adjacent to the staple-receiving hole;

the first shank-receiving hole normally traversing through the first locking plate; and the free-end leg of the U-shaped shank traversing through the padlock staple and the first shank-receiving hole.

17. The tamper-proof padlock box as claimed in claim 11 comprising:

the guard lock box further comprising a sliding enclosure;

the sliding enclosure being positioned about the padlock;

the sliding enclosure being connected perpendicular to the removable top; and the sliding enclosure being slidably engaged within the tubular body.

18. The tamper-proof padlock box as claimed in claim 11 comprising:

wherein the guard lock box and the padlock are configured into a standby configuration;

the guard lock box further comprising a second locking plate and a second shank-receiving hole;

the second locking plate being positioned in between the bottom and the staple-receiving hole;

the second locking plate being connected perpendicular to a left sidewall of the tubular body;

the second shank-receiving hole normally traversing through the second locking plate;

the locking body being positioned adjacent and parallel to the left sidewall;

a free-end leg of the U-shaped shank traversing through the second shank-receiving hole; and the free-end leg of the U-shaped shank being mechanically engaged within the locking body.

19. The tamper-proof padlock box as claimed in claim 13 comprising:

at least one indication disk;

a housing plate;

a viewing slot;

the housing plate being positioned parallel and offset from the bottom;

the housing plate being perimetrically connected within the tubular body;

the body-receiving bracket being movable with respect to the housing plate;

the semi-circular guide slot traversing through the housing plate;

the at least one indication disk being positioned in between the bottom and the housing plate;

the at least one indication disk being rotatably mounted within the tubular body;

the at least one indication disk being eccentrically engaged with the slider knob; and the viewing slot laterally traversing into the tubular body, in between the bottom and the housing plate.

* * * * *